US009129479B2

(12) United States Patent
Ballone et al.

(10) Patent No.: US 9,129,479 B2
(45) Date of Patent: Sep. 8, 2015

(54) GAMING DEVICE HAVING ADDITIONAL PLAY OPPORTUNITIES FROM AN INITIAL WAGER

(75) Inventors: Jonathan Ballone, New York, NY (US); Anthony Singer, Ramsey, NJ (US); Aaron Stuart Zoble, Ramsey, NJ (US); Philip B. Welty, Suffern, NY (US); Uri Vasas, Jersey City, NJ (US)

(73) Assignee: High 5 Games, LLC, New York, NY (US)

( * ) Notice: Subject to any disclaimer, the term of this patent is extended or adjusted under 35 U.S.C. 154(b) by 0 days.

(21) Appl. No.: 13/572,581

(22) Filed: Aug. 10, 2012

(65) Prior Publication Data

US 2013/0102377 A1 Apr. 25, 2013

Related U.S. Application Data

(60) Provisional application No. 61/522,110, filed on Aug. 10, 2011.

(51) Int. Cl.
*A63F 9/24* (2006.01)
*G07F 17/32* (2006.01)

(52) U.S. Cl.
CPC ..... *G07F 17/3267* (2013.01); *G07F 17/3288* (2013.01)

(58) Field of Classification Search
USPC ..... 463/16, 20
See application file for complete search history.

(56) References Cited

U.S. PATENT DOCUMENTS

| | | | | |
|---|---|---|---|---|
| 2004/0192431 | A1 * | 9/2004 | Singer et al. | 463/20 |
| 2006/0058097 | A1 * | 3/2006 | Berman et al. | 463/20 |
| 2006/0287036 | A1 * | 12/2006 | Daly et al. | 463/16 |
| 2007/0072665 | A1 * | 3/2007 | Muir | 463/12 |
| 2008/0102928 | A1 * | 5/2008 | Daley | 463/20 |
| 2009/0124325 | A1 * | 5/2009 | Wadleigh et al. | 463/20 |
| 2009/0181758 | A1 * | 7/2009 | Loose et al. | 463/20 |
| 2009/0215515 | A1 * | 8/2009 | Meyer | 463/20 |
| 2010/0004049 | A1 * | 1/2010 | Ching et al. | 463/20 |
| 2010/0004050 | A1 * | 1/2010 | Caputo et al. | 463/21 |
| 2010/0022297 | A1 * | 1/2010 | Saunders | 463/21 |
| 2010/0137047 | A1 * | 6/2010 | Englman et al. | 463/6 |
| 2010/0197377 | A1 * | 8/2010 | Aoki et al. | 463/20 |
| 2011/0223986 | A1 * | 9/2011 | Little | 463/20 |
| 2012/0270632 | A1 * | 10/2012 | Masen | 463/20 |

* cited by examiner

*Primary Examiner* — Jason Yen
(74) *Attorney, Agent, or Firm* — Jon Fallon, Esq.; Candice Hebden Osnato, Esq.

(57) ABSTRACT

Embodiments of the present invention relate to a slot machine having a variety of methods of play to provide opportunities for receiving additional spins from the same initial wager. In one embodiment of the present invention, a game device comprises: a display device; an input device; and a processor for accessing a plurality of instructions which cause the processor to provide a game comprising: a plurality of reels, each of the reels including a plurality of symbol positions; a plurality of symbols at the plurality of symbol positions on the reels; and at least one predetermined winning symbol combination of a plurality of winning symbol combinations, wherein the predetermined winning symbol combination is associated with an award; wherein the award comprises at least a plurality of credits issued to a player, and at least a free subsequent game.

19 Claims, 13 Drawing Sheets

GAMING DEVICE HAVING ADDITIONAL PLAY OPPORTUNITIES FROM AN INITIAL WAGER

CROSS-REFERENCE TO RELATED APPLICATIONS

This application claims priority to U.S. Provisional Patent Application Ser. No. 61/522,110, filed Aug. 10, 2011, and titled "Gaming Device having Additional Play Opportunities from an Initial Wager," the disclosure of which is incorporated herein by reference in its entirety.

BACKGROUND

1. Field of the Invention

Embodiments of the present invention generally relate to a gaming device having additional play opportunities from an initial wager. More specifically, embodiments of the present invention relate to a slot machine having a variety of methods of play to provide opportunities for receiving additional spins from the same initial wager.

2. Description of Related Art

To play a conventional slot machine, a player deposits money in the form of coins, gaming tokens or paper currency either into a coin head or bill acceptor. The coins and gaming tokens are collected in a reservoir inside the gaming machine while the paper currency is collected in the bill acceptor inside the gaming machine. If the coins, gaming tokens or paper currency are validated as authentic, the player accrues the appropriate number of playing credits on a credit meter. For example, a twenty-five cent gaming machine will accrue four credits for each dollar deposited into the gaming machine.

After accruing credits on the credit meter, the player determines how many credits he wishes to wager on the next spin of the slot reels. After setting the wager, the player spins the reels by pressing the spin button or by pulling a handle. When the reels stop spinning, symbols are displayed on the slot reels. The player then collects credits for winning combinations, if any, according to a pay table. More specifically, the slot machine operates as follows:

Symbol Matrix.

Slot symbols are displayed on 3 or more slot reels (also called "columns") placed adjacent to each other. Each column contains at least 3 rows, with a symbol in each row. The resulting matrix of symbols typically ranges from 3 columns by 3 rows with 9 total symbols to 5 columns by 3 rows with 15 total symbols. Within the symbol matrix, positions on the slot reels may be referred to according to column, from left to right, and row, from the top to bottom ("symbol positions"). For example: symbol position 1/2 is located in column 1 (i.e., left-most column) and row 2 (i.e., middle row).

Winning Combinations.

Players collect credits for predetermined winning symbol combinations that appear in specific positions ("pay lines") on the slot reels. Winning combinations typically require that three or more of the same symbols appear adjacent to each other starting from the leftmost position of a pay line ("line pays"). For example: a player may collect a line pay if 3 Banana symbols appeared in symbol positions 1/1, 2/1, 3/1 on a pay line using symbol positions 1/1, 2/1, 3/1, 4/1, and 5/1.

Players may also collect credits for predetermined winning combinations that appear anywhere on a pay line ("line scatter pays") or anywhere on the slot reels ("reel scatter pays"). For example, a player may collect a line scatter pay if 3 Banana symbols appeared in symbol positions 1/1, 3/1, 5/1 on a pay line using symbol positions 1/1, 2/1, 3/1, 4/1, and 5/1; and collect a reel scatter pay if 3 Banana symbols appeared anywhere on the slot reels.

Pay Table.

Credits are awarded to the player for each winning symbol combination based on a predetermined schedule. For line pays and line scatter pays, the number of credits wagered on the winning pay line multiplies the number of credits indicated by the pay table. For example, a player may wager two credits each on five pay lines, spin the reels, and collect twice the amount indicated on the pay table for a line pay or line scatter pay appearing on any of the five played pay lines. For reel scatter pays, the total number of credits wagered multiplies the number of credits indicated by the pay table. For example, a player may wager ten total credits, spin the reels, and collect ten times the amount indicated on the pay table for a reel scatter pay appearing on anywhere on the slot reels.

Following any type of pay (e.g., line pays, line scatter pays, or reel scatter pays), credits won are added to the player's credit balance shown on the credit meter. As long as the player has credits on the credit meter, the player may continue to play the game. Following any spin, the player may collect the credit balance by pressing the Cash Out button.

While the above elements are common to many slot machine games, without more, players are often easily bored by simple conventional game play. Therefore, there is a need for a gaming apparatus having an improved game play comprising opportunities for receiving additional spins from the same initial wager.

SUMMARY

Embodiments of the present invention generally relate to a gaming device having additional play opportunities from an initial wager. More specifically, embodiments of the present invention relate to a slot machine having a variety of methods of play to provide opportunities for receiving additional spins from the same initial wager.

In one embodiment of the present invention, a game device comprises: a display device; an input device; and a processor for accessing a plurality of instructions which, when executed by the one processor, cause the at least one processor to operate with the at least one display device and the at least one input device to: provide a game comprising: a plurality of reels, each of the reels including a plurality of symbol positions; a first reel set and a second reel set, each reel set comprising a plurality of reel stops and each reel stop comprising a symbol; a first plurality of symbols at the plurality of symbol positions on the reels, the first plurality of symbols selected from the first reel set; at least one activator symbol positioned within the first plurality of symbols; and a second plurality of symbols to replace the first plurality of symbols, the second plurality of symbols selected from the second reel set; and at least one predetermined winning symbol combination of a plurality of winning symbol combinations, wherein the predetermined winning symbol combination is associated with an award.

In another embodiment of the present invention, a game device comprises: a display device; an input device; and a processor for accessing a plurality of instructions which, when executed by the one processor, cause the at least one processor to operate with the at least one display device and the at least one input device to: provide a game comprising: a plurality of reels, each of the reels including a plurality of symbol positions; a plurality of symbols at the plurality of symbol positions on the reels; and at least one predetermined winning symbol combination of a plurality of winning symbol combinations, wherein the predetermined winning symbol combination is associated with an award; wherein the award comprises at least a plurality of credits issued to a player, and at least a free subsequent game.

In yet another embodiment of the present invention, a game device comprises: a display device; an input device; and a processor for accessing a plurality of instructions which, when executed by the one processor, cause the at least one processor to operate with the at least one display device and the at least one input device to: provide a game comprising: a plurality of reels, each of the reels including a plurality of symbol positions; a first reel set and a second reel set, each reel set comprising a plurality of reel stops and each reel stop comprising a symbol; a first plurality of symbols at the plurality of symbol positions on the reels, the first plurality of symbols selected from the first reel set; at least one designated symbol positioned within the first plurality of symbols; and a second plurality of symbols to replace a subset of the first plurality of symbols, the second plurality of symbols selected from the second reel set; and at least one predetermined winning symbol combination of a plurality of winning symbol combinations, wherein the predetermined winning symbol combination is associated with an award.

BRIEF DESCRIPTION OF THE DRAWINGS

So the manner in which the above recited features of the present invention can be understood in detail, a more particular description of embodiments of the present invention, briefly summarized above, may be had by reference to embodiments, which are illustrated in the appended drawings. It is to be noted, however, the appended drawings illustrate only typical embodiments of embodiments encompassed within the scope of the present invention, and, therefore, are not to be considered limiting, for the present invention may admit to other equally effective embodiments, wherein.

Figure 1A:
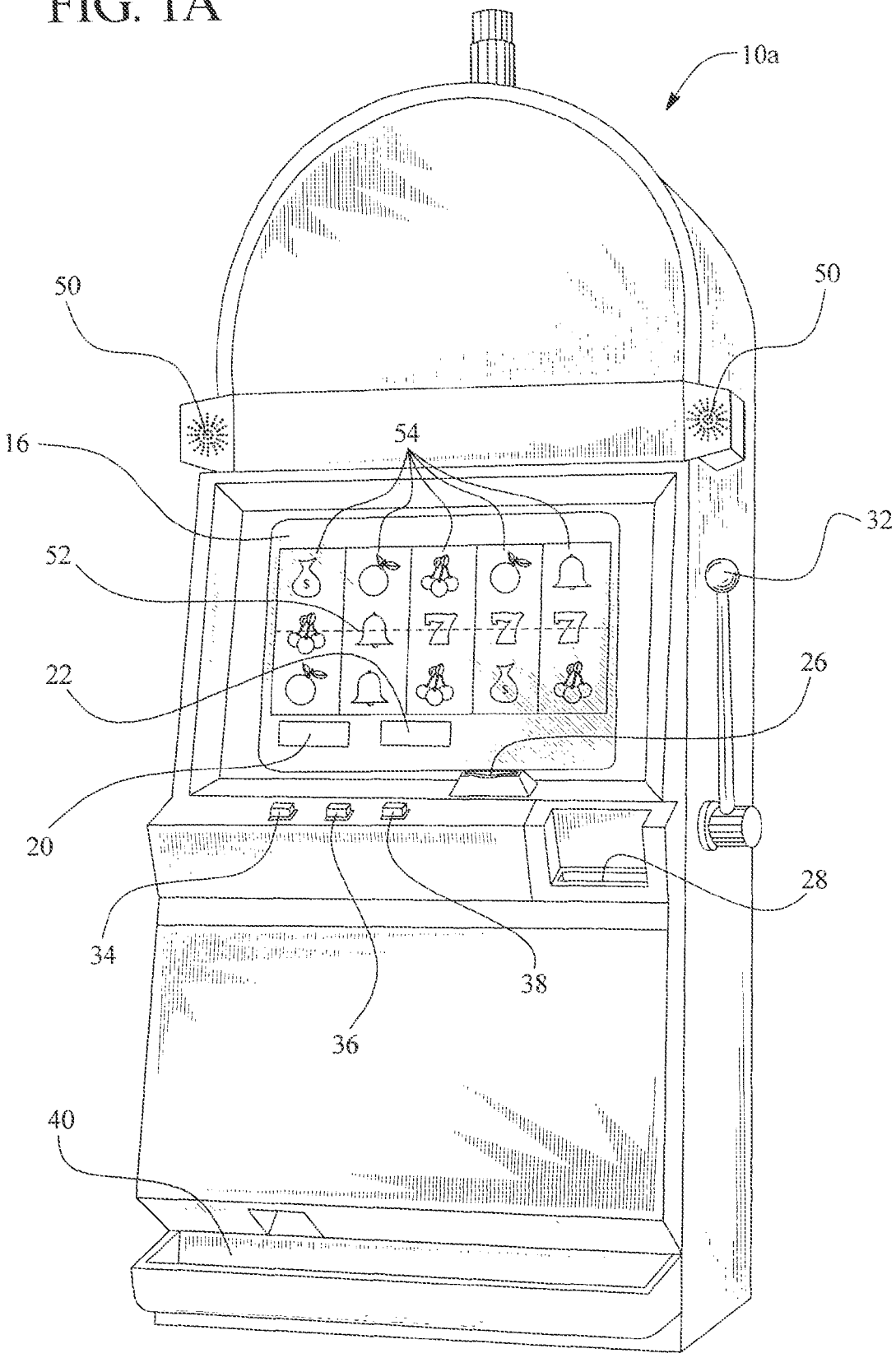
FIG. 1A depicts a front perspective view of a gaming device in the form of a slot machine in accordance with one embodiment of the present invention.

The headings used herein are for organizational purposes only and are not meant to be used to limit the scope of the description or the claims. As used throughout this application, the word "may" is used in a permissive sense (i.e., meaning having the potential to), rather than the mandatory sense (i.e., meaning must). Similarly, the words "include", "including", and "includes" mean including but not limited to. To facilitate understanding, like reference numerals have been used, where possible, to designate like elements common to the figures.

DETAILED DESCRIPTION

In the following detailed description, numerous specific details are set forth in order to provide a thorough understanding of exemplary embodiments or other examples described herein. However, it will be understood that these examples may be practiced without the specific details. In other instances, well-known methods, procedures, and components have not been described in detail, so as to not obscure the following description. Furthermore, the examples disclosed herein are for exemplary purposes only and other examples may be employed in lieu of, or in combination with, the examples disclosed.

Embodiments of the present invention generally relate to a gaming device having additional play opportunities from an initial wager. More specifically, embodiments of the present invention relate to a slot machine having a variety of methods of play to provide opportunities for receiving additional spins from the same initial wager.

Figure 1B:
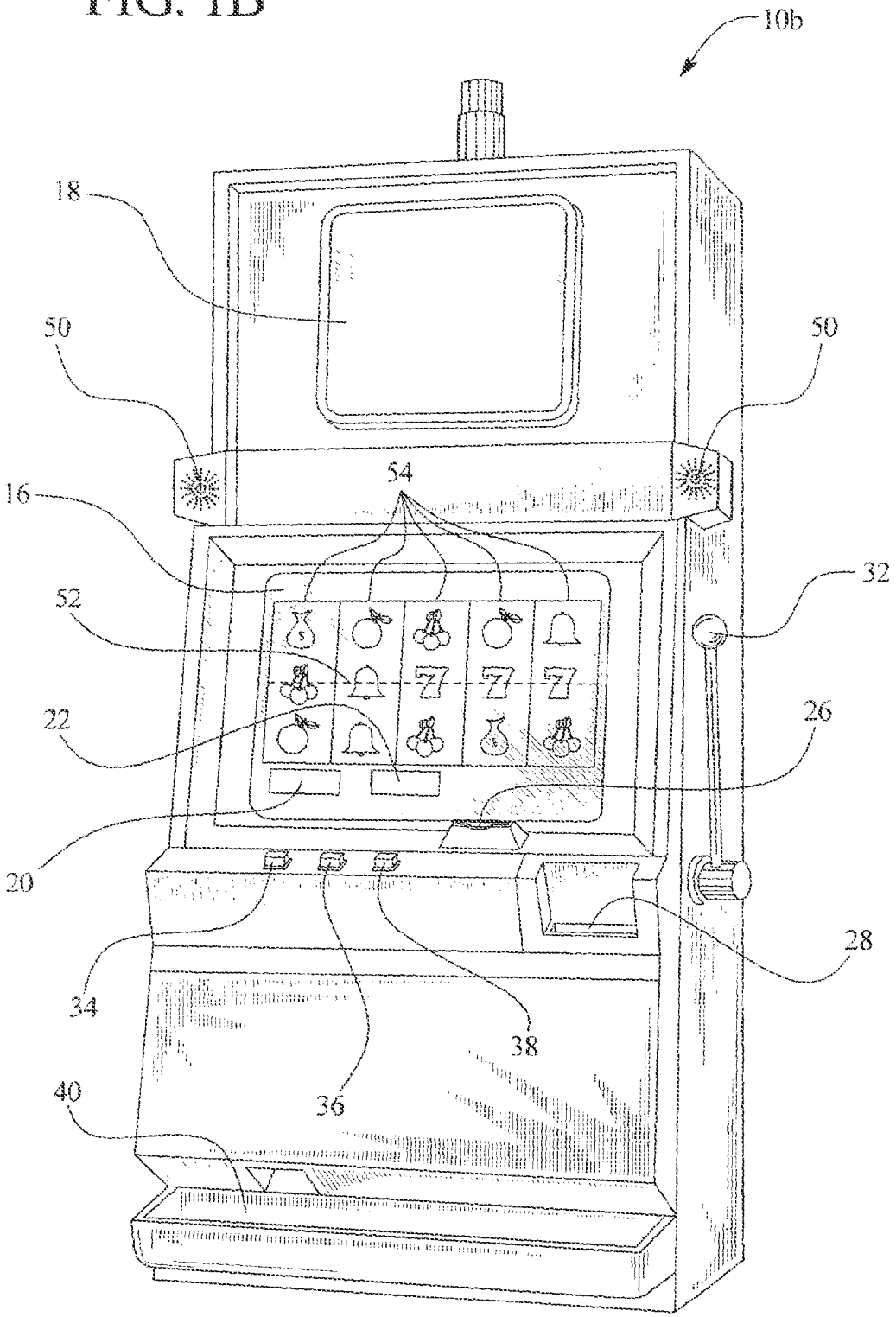
FIG. 1B depicts a front perspective view of a gaming device in the form of a slot machine in accordance with another embodiment of the present invention.

Two alternative embodiments of the gaming device of the present invention are illustrated in FIGS. 1A and 1B as gaming device 10*a* and gaming device 10*b*, respectively. Gaming device 10*a* and/or gaming device 10*b* are generally referred to herein as gaming device 10.

In one embodiment, as illustrated in FIGS. 1A and 1B, gaming device 10 has a support structure, housing or cabinet which provides support for a plurality of displays, inputs, controls and other features of a conventional gaming machine. It is configured so that a player can operate it while standing or sitting. The gaming device may be positioned on a base or stand or can be configured as a pub-style table-top game (not shown) which a player can operate preferably while sitting. As illustrated by the different configurations shown in FIGS. 1A and 1B, the gaming device can be constructed with varying cabinet and display configurations.

Figure 1C:
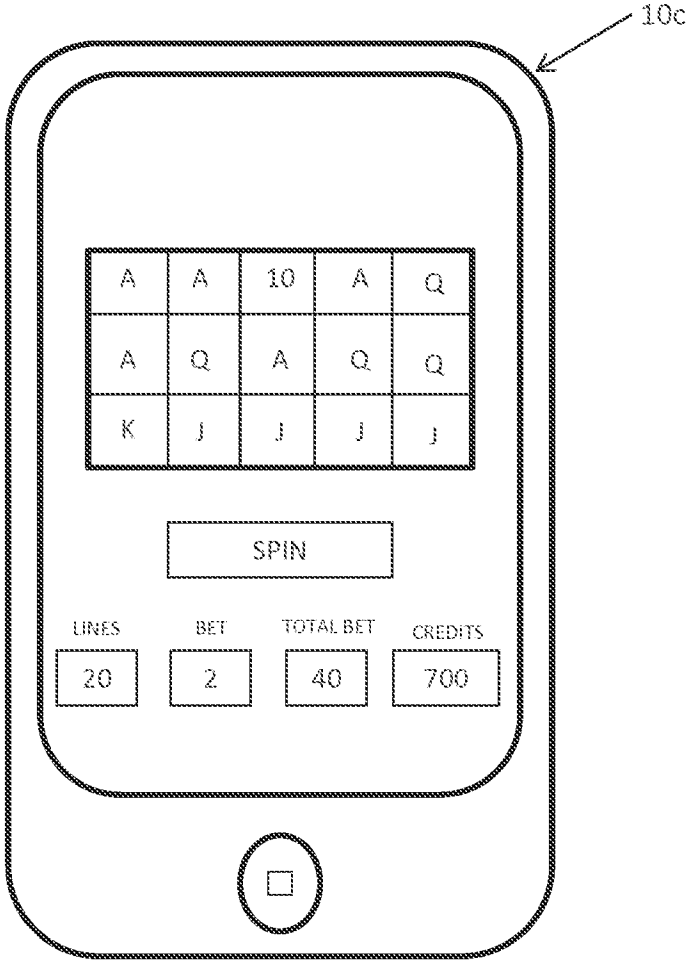
FIG. 1C depicts a front perspective view of a gaming device in the form of a mobile device in accordance with one embodiment of the present invention.
Figure 1D:
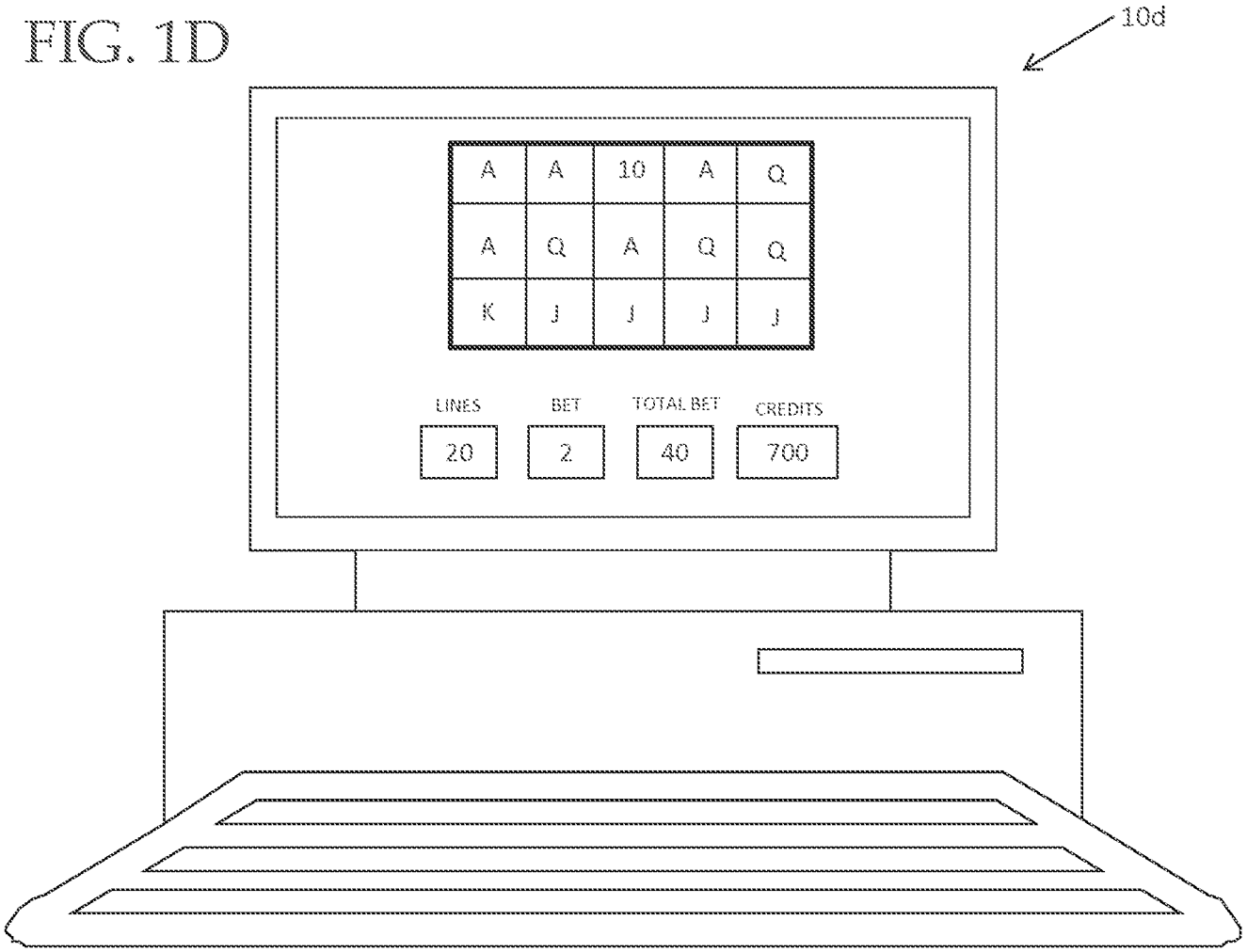
FIG. 1D depicts a front perspective view of a gaming device in the form of a personal computer in accordance with one embodiment of the present invention.
Figure 2A:
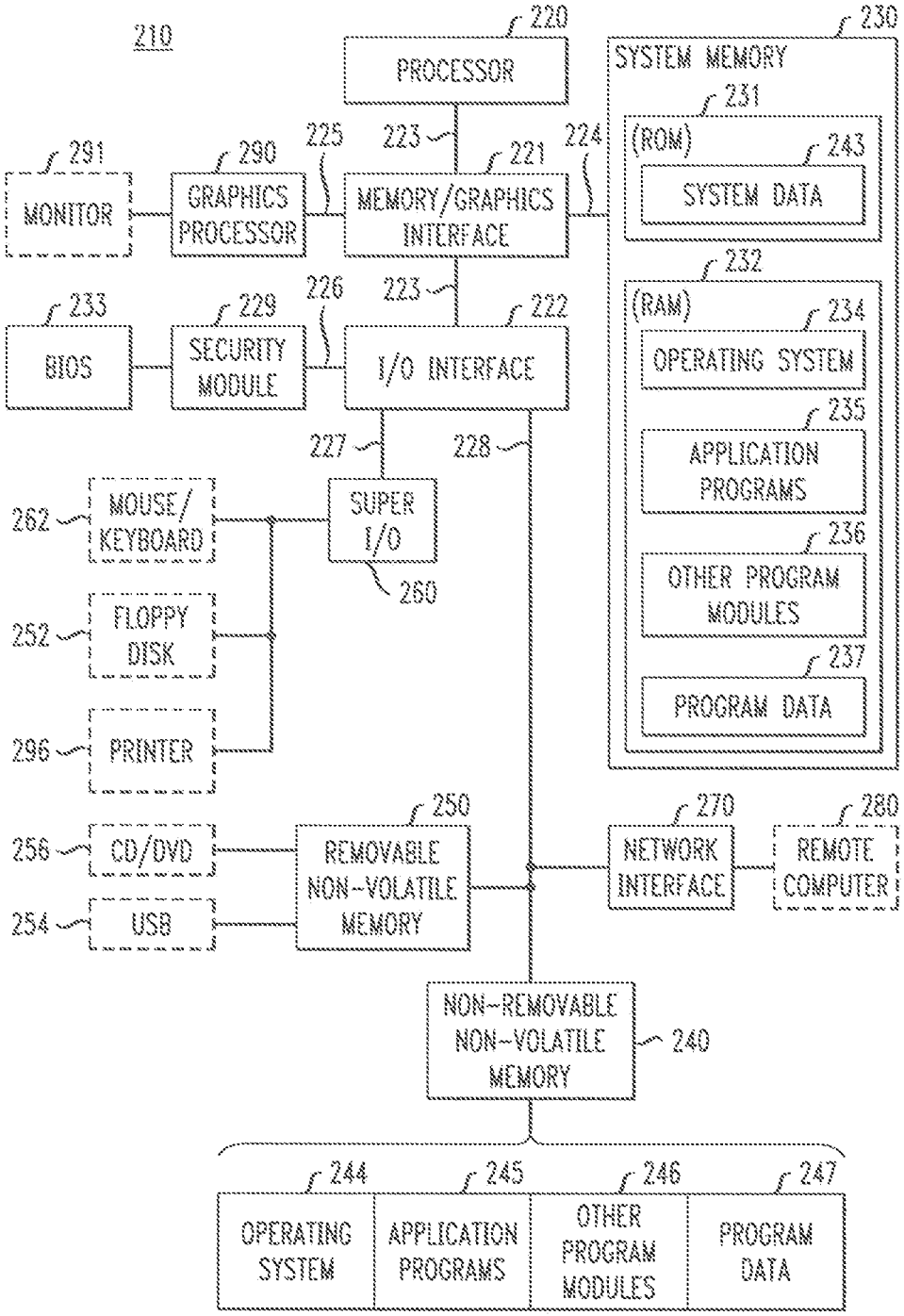
FIG. 2A depicts a schematic block diagram of a general purpose computer system, which may be used with any of the gaming devices of FIGS. 1A-1D, in accordance with embodiments of the present invention.

In several embodiments, the electronic gaming devices, for example, as shown in FIGS. 1A-1D, may comprise all or part of a general purpose computer system, for example, the general purpose computer system of FIG. 2. It should be appreciated, however, the general purpose computing system of FIG. 2 is merely an exemplary embodiment of an electronic device, and actual electronic devices may comprise any one or more components shown in FIG. 2A, suitable for embodiments of the present invention.

With reference to FIG. 2A, a general purpose computer system in the form of a computer 210 is shown. As understood by embodiments of the present invention, components shown in dashed outline are not part of the computer 210, but are used to illustrate the exemplary embodiment of FIG. 2A. Components of computer 210 may include, but are not limited to, a processor 220, a system memory 230, a memory/graphics interface 221, also known as a Northbridge chip, and an I/O interface 222, also known as a Southbridge chip. The system memory 230 and a graphics processor 290 may be coupled to the memory/graphics interface 221. A monitor 291 or other graphic output device may be coupled to the graphics processor 290.

A series of system busses may couple various system components including a high speed system bus 223 between the processor 220, the memory/graphics interface 221 and the I/O interface 222, a front-side bus 224 between the memory/graphics interface 221 and the system memory 230, and an advanced graphics processing (AGP) bus 225 between the memory/graphics interface 221 and the graphics processor 290. The system bus 223 may be any of several types of bus structures including, by way of example, and not limitation, such architectures include Industry Standard Architecture (ISA) bus, Micro Channel Architecture (MCA) bus and Enhanced ISA (EISA) bus. As system architectures evolve, other bus architectures and chip sets may be used but often generally follow this pattern. For example, companies such as Intel and AMD support the Intel Hub Architecture (IHA) and the Hypertransport architecture, respectively.

The computer 210 typically includes a variety of computer readable media. Computer readable media can be any available media that can be accessed by computer 210 and includes both volatile and nonvolatile media, removable and non-removable media. By way of example, and not limitation, computer readable media may comprise computer storage media and communication media. Computer storage media includes volatile and nonvolatile, removable and non-removable media implemented in any method or technology for storage of information such as computer readable instructions, data structures, program modules or other data. Computer storage media includes, but is not limited to, RAM, ROM, EEPROM, flash memory or other memory technology, CD-ROM, digital versatile disks (DVD) or other optical disk storage, magnetic cassettes, magnetic tape, magnetic disk storage or other magnetic storage devices, or any other medium that can be used to store the desired information and can accessed by the computer 210.

Communication media typically embodies computer readable instructions, data structures, program modules or other data in a modulated data signal such as a carrier wave or other transport mechanism and includes any information delivery media. The term "modulated data signal" means a signal that has one or more of its characteristics set or changed in such a manner as to encode information in the signal. By way of example, and not limitation, communication media includes wired media such as a wired network or direct-wired connection, and wireless media such as acoustic, RF, infrared and other wireless media. Combinations of the any of the above should also be included within the scope of computer readable media.

The system memory 230 includes computer storage media in the form of volatile and/or nonvolatile memory such as read only memory (ROM) 231 and random access memory (RAM) 232. The system ROM 231 may contain permanent system data 243, such as identifying and manufacturing information. In some embodiments, a basic input/output system (BIOS) may also be stored in system ROM 231. RAM 232 typically contains data and/or program modules that are immediately accessible to and/or presently being operated on by processor 220. By way of example, and not limitation, FIG. 2 illustrates operating system 234, application programs 235, other program modules 236, and program data 237.

The I/O interface 222 may couple the system bus 223 with a number of other buses 226, 227 and 228 that couple a variety of internal and external devices to the computer 210. A serial peripheral interface (SPI) bus 226 may connect to a BIOS memory 233 containing the basic routines that help to transfer information between elements within computer 210, such as during start-up.

In some embodiments, a security module 229 may be incorporated to manage receipt of money/credits, issuance of money/credits, and enforcement of policies, as may be required in the gaming industry. In many embodiments, such security module 229 may be coupled with a payment acceptor built into a physical machine. A payment acceptor may include a coin slot and a payment, note or bill acceptor, where the player inserts money, coins or tokens. For example, the player can place coins in the coin slot or paper money, ticket or voucher into the payment, note or bill acceptor. In other embodiments, devices such as readers or validators for credit cards, debit cards or credit slips could be used for accepting payment. In one embodiment, a player may insert an identification card into a card reader of the gaming device. In one embodiment, the identification card is a smart card having a programmed microchip or a magnetic strip coded with a player's identification, credit totals and other relevant information. In one embodiment, money may be transferred to a gaming device through electronic funds transfer. When a player funds the gaming device, the processor determines the amount of funds entered and the corresponding amount is shown on the credit or other suitable display as described above.

A super input/output chip 260 may be used to connect to a number of 'legacy' peripherals, such as floppy disk 252, keyboard/mouse/buttons 262, and printer 296, as examples. The super I/O chip 260 may be connected to the I/O interface 222 with a low pin count (LPC) bus, in some embodiments. The super I/O chip 260 is widely available in the commercial marketplace.

In one embodiment, bus 228 may be a Peripheral Component Interconnect (PCI) bus, or a variation thereof, may be used to connect higher speed peripherals to the I/O interface 222. A PCI bus may also be known as a Mezzanine bus. Variations of the PCI bus include the Peripheral Component Interconnect-Express (PCI-E) and the Peripheral Component Interconnect-Extended (PCI-X) busses, the former having a serial interface and the latter being a backward compatible parallel interface. In other embodiments, bus 228 may be an advanced technology attachment (ATA) bus, in the form of a serial ATA bus (SATA) or parallel ATA (PATA).

The computer 210 may also include other removable/non-removable, volatile/nonvolatile computer storage media. By way of example only, FIG. 2A illustrates a hard disk drive 240 that reads from or writes to non-removable, nonvolatile magnetic media. Removable media, such as a universal serial bus (USB) memory 252 or CD/DVD drive 256 may be connected to the PCI bus 228 directly or through an interface 250. Other removable/non-removable, volatile/nonvolatile computer storage media that can be used in the exemplary operating environment include, but are not limited to, magnetic tape cassettes, flash memory cards, digital versatile disks, digital video tape, solid state RAM, solid state ROM, and the like.

The drives and their associated computer storage media, discussed above and illustrated in FIG. 2A, provide storage of computer readable instructions, data structures, program modules and other data for the computer 210. In FIG. 2A, for example, hard disk drive 240 is illustrated as storing operating system 244, application programs 245, other program modules 246, and program data 247. Note that these components can either be the same as or different from operating system 234, application programs 235, other program modules 236, and program data 237. Operating system 244, application programs 245, other program modules 246, and program data 247 are given different numbers here to illustrate that, at a minimum, they are different elements within the computer 210. A user may enter commands and information into the computer 210 through input devices such as a mouse/keyboard 262 or other input device combination. Other input devices (not shown) may include a microphone, joystick, game pad, satellite dish, scanner, or the like. These and other input devices are often connected to the processor 220 through one of the I/O interface busses, such as the SPI 226, the LPC 227, or the PCI 228, but other busses may be used. In some embodiments, other devices may be coupled to parallel ports, infrared interfaces, game ports, and the like (not depicted), via the super I/O chip 260.

The computer 210 may operate in a networked environment using logical connections to one or more remote computers, such as a remote computer 280 via a network interface controller (NIC) 270. The remote computer 280 may be a personal computer, a server, a router, a network PC, a peer device or other common network node, and typically includes many or all of the elements described above relative to the computer 210. The logical connection between the NIC 270 and the remote computer 280 depicted in FIG. 2 may include a local area network (LAN), an Ethernet-based network, a wide area network (WAN), or both, but may also include other networks. Such networking environments are commonplace in offices, enterprise-wide computer networks, intranets, and the Internet.

Returning to FIGS. 1A-1D, in one embodiment, as discussed in more detail below, the gaming device randomly generates awards and/or other game outcomes based on probability data. That is, each award or other game outcome is associated with a probability and the gaming device generates the award or other game outcome to be provided to the player based on the associated probabilities. In this embodiment, since the gaming device generates outcomes randomly or based upon a probability calculation, there is no certainty that the gaming device will ever provide the player with any specific award or other game outcome.

In another embodiment, as discussed in more detail below, the gaming device employs a predetermined or finite set or pool of awards or other game outcomes. In this embodiment, as each award or other game outcome is provided to the player, the gaming device removes the provided award or other game outcome from the predetermined set or pool. Once removed from the set or pool, the specific provided award or other game outcome cannot be provided to the player again. This type of gaming device provides players with all of the available awards or other game outcomes over the course of the play cycle and guarantees the amount of actual wins and losses.

As shown by FIGS. 1A and 1B, and supported by the elements depicted in FIG. 2A, many embodiments of the present invention comprise at least one, and often a plurality, of input devices in communication with the processor. The input devices can include any suitable device which enables the player to produce an input signal which is read by the processor, for instructing the game and/or gaming device to do something. In one embodiment, after appropriate funding of the gaming device, the input device is a game activation device, such as a pull arm 32 or a play button 34 which is used by the player to start any primary game or sequence of events in the gaming device. The play button can be any suitable play activator such as a bet one button, a max bet button or a repeat the bet button. In one embodiment, upon appropriate funding, the gaming device begins the game play automatically. In another embodiment, upon the player engaging one of the play buttons, the gaming device automatically activates game play.

In one embodiment, as shown in FIGS. 1A and 1B, one input device is a bet one button 36. The player places a bet by pushing the bet one button. The player can increase the bet by one credit each time the player pushes the bet one button. When the player pushes the bet one button, the number of credits shown in the credit display preferably decreases by one, and the number of credits shown in the bet display preferably increases by one. In another embodiment, one input device is a bet max button (not shown) which enables the player to bet the maximum wager permitted for a game of the gaming device.

In one embodiment, one input device is a cash out button 38. The player may push the cash out button and cash out to receive a cash payment or other suitable form of payment corresponding to the number of remaining credits. In one embodiment, when the player cashes out, the player receives the coins or tokens in a coin payout tray 40. In one embodiment, when the player cashes out, the player may receive other payout mechanisms such as tickets or credit slips redeemable by a cashier or funding to the player's electronically recordable identification card.

In one embodiment, one input device is a touch-screen coupled with a touch-screen controller, or some other touch-sensitive display overlay to allow for player interaction with the images on the display. The touch-screen and the touch-screen controller are connected to a video controller. A player can make decisions and input signals into the gaming device by touching touch-screen at the appropriate places.

In one embodiment, the gaming device includes a sound generating device controlled by one or more sound cards which function in conjunction with the processor. In one embodiment, the sound generating device includes at least one and preferably a plurality of speakers or other sound generating hardware and/or software for generating sounds, such as playing music for the primary and/or secondary game or for other modes of the gaming device, such as an attract mode. In one embodiment, the gaming device provides dynamic sounds coupled with attractive multimedia images displayed on one or more of the display devices to provide an audio-visual representation or to otherwise display full-motion video with sound to attract players to the gaming device. During idle periods, the gaming device may display a sequence of audio and/or visual attraction messages to attract potential players to the gaming device. The videos may also be customized for or to provide any appropriate information.

In one embodiment, the gaming machine may include a player or other sensor, such as a camera in communication with the processor (and possibly controlled by the processor) that is selectively positioned to acquire an image of a player actively using the gaming device and/or the surrounding area of the gaming device. In one embodiment, the camera may be configured to selectively acquire still or moving (e.g., video) images and may be configured to acquire the images in either an analog, digital or other suitable format. The display devices may be configured to display the image acquired by the camera as well as display the visible manifestation of the game in split screen or picture-in-picture fashion. For example, the camera may acquire an image of the player and that image can be incorporated into the primary and/or secondary game as a game image, symbol or indicia.

Suitable gaming devices may incorporate any suitable wagering primary or base game. The gaming machine or device of embodiments of the present invention may include some or all of the features of conventional gaming machines or devices. The primary or base game may comprise any suitable reel-type game, card game, number game or other game of chance susceptible to representation in an electronic or electromechanical form which produces a random outcome based on probability data upon activation from a wager. That is, different primary wagering games, such as video poker games, video blackjack games, video Keno, video bingo or any other suitable primary or base game may be implemented into an embodiment of the present invention.

In one embodiment, a base or primary game may be a slot game with one or more paylines 52. The paylines may be horizontal, vertical, circular, diagonal, angled or any combination thereof. In this embodiment, the gaming device displays at least one and preferably a plurality of reels 54, for example, having three to five reels 54 in either electromechanical form with mechanical rotating reels or video form with simulated reels and movement thereof. In one embodiment, an electromechanical slot machine includes a plurality of adjacent, rotatable wheels which may be combined and operably coupled with an electronic display of any suitable type. In another embodiment, if the reels 54 are in video form, the plurality of simulated video reels 54 are displayed on one or more of the display devices as described above. Each reel 54 displays a plurality of indicia such as bells, hearts, fruits, numbers, letters, bars or other images which may generally correspond to a theme associated with the gaming device. In this embodiment, the gaming device awards prizes when the reels of the primary game stop spinning if specified types and/or configurations of indicia or symbols occur on an active pay line or otherwise occur in a winning pattern.

In one embodiment, in addition to winning credits in a base or primary game, the gaming device may also give players the opportunity to win credits in a bonus or secondary game or bonus or secondary round. The bonus or secondary game enables the player to obtain a prize or payout in addition to the prize or payout, if any, obtained from the base or primary game. In general, a bonus or secondary game produces a significantly higher level of player excitement than the base or primary game because it provides a greater expectation of winning than the base or primary game and is accompanied with more attractive or unusual features than the base or primary game.

In one embodiment, the bonus or secondary game may be any type of suitable game, either similar to or completely different from the base or primary game. In one embodiment, the gaming device includes a program which will automatically begin a bonus round when the player has achieved a triggering event or qualifying condition in the base or primary game. In one embodiment, the triggering event or qualifying condition may be a selected outcome in the primary game or a particular arrangement of one or more indicia on a display device in the primary game, such as the number seven appearing on three adjacent reels along a payline in the primary slot game embodiment seen in FIGS. 1A and 1B. In another embodiment, the triggering event or qualifying condition may be by exceeding a certain amount of game play (number of games, number of credits, amount of time), reaching a specified number of points earned during game play or as a random award.

In one embodiment, once a player has qualified for a bonus game, the player may subsequently enhance his/her bonus game participation through continued play on the base or primary game. Thus, for each bonus qualifying event, such as a bonus symbol, that the player obtains, a given number of bonus game wagering points or credits may be accumulated in a "bonus meter" programmed to accrue the bonus wagering credits or entries toward eventual participation in a bonus game. The occurrence of multiple such bonus qualifying events in the primary game may result in an arithmetic or geometric increase in the number of bonus wagering credits awarded. In one embodiment, extra bonus wagering credits may be redeemed during the bonus game to extend play of the bonus game.

In one embodiment, no separate entry fee or buy in for a bonus game need be employed. That is, a player may not purchase an entry into a bonus game; he must win or earn entry through play of the primary game and, thus, play of the primary game is encouraged. In another embodiment, qualification of the bonus or secondary game could be accomplished through a simple "buy in" by the player if, for example, the player has been unsuccessful at qualifying through other specified activities.

Figure 2B:
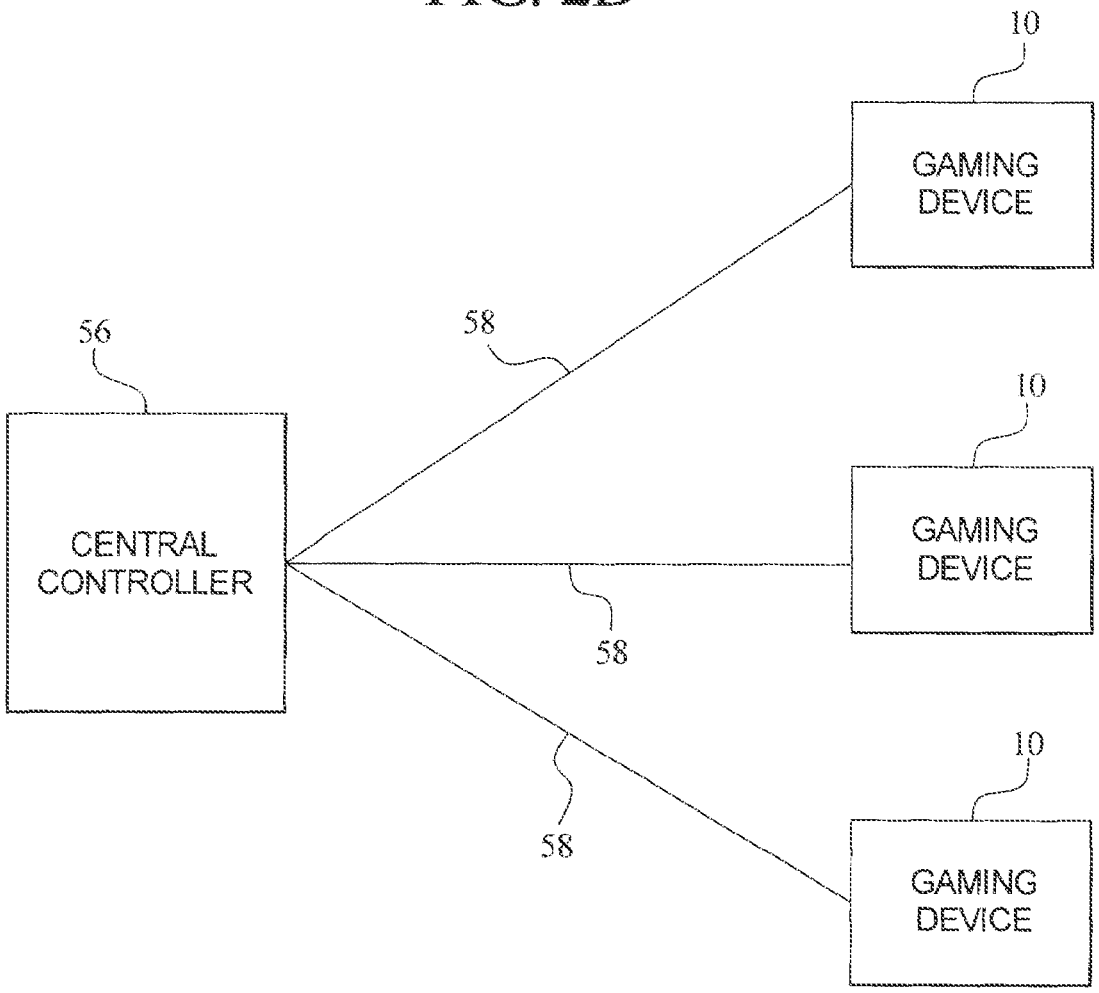
FIG. 2B depicts a schematic block diagram illustrating a plurality of gaming terminals and communication with a central controller in accordance with one embodiment of the present invention.

In one embodiment, as illustrated in FIG. 2B, one or more of the gaming devices 10 of embodiments of the present invention may be connected to each other through a data network or a remote communication link 58 with some or all of the functions of each gaming device provided at a central location such as a central server or central controller 56. More specifically, the processor of each gaming device may be designed to facilitate transmission of signals between the individual gaming device and the central server or controller.

In one embodiment, the game outcome provided to the player is determined by a central server or controller and provided to the player at the gaming device of an embodiment of the present invention. In this embodiment, each of a plurality of such gaming devices are in communication with the central server or controller. Upon a player initiating game play at one of the gaming devices, the initiated gaming device communicates a game outcome request to the central server or controller.

In one embodiment, the central server or controller receives the game outcome request and randomly generates a game outcome for the primary game based on probability data. In another embodiment, the central server or controller randomly generates a game outcome for the secondary game based on probability data. In another embodiment, the central server or controller randomly generates a game outcome for both the primary game and the secondary game based on probability data. In this embodiment, the central server or controller is capable of storing and utilizing program code or other data similar to the processor and memory device of the gaming device.

In an alternative embodiment, the central server or controller maintains one or more predetermined pools or sets of predetermined game outcomes. In this embodiment, the central server or controller receives the game outcome request and independently selects a predetermined game outcome from a set or pool of game outcomes. The central server or controller flags or marks the selected game outcome as used. Once a game outcome is flagged as used, it is prevented from further selection from the set or pool and cannot be selected by the central controller or server upon another wager. The provided game outcome can include a primary game outcome, a secondary game outcome, primary and secondary game outcomes, or a series of game outcomes such a free games.

The central server or controller communicates the generated or selected game outcome to the initiated gaming device. The gaming device receives the generated or selected game outcome and provides the game outcome to the player. In an alternative embodiment, how the generated or selected game outcome is to be presented or displayed to the player, such as a reel symbol combination of a slot machine or a hand of cards dealt in a card game, is also determined by the central server or controller and communicated to the initiated gaming device to be presented or displayed to the player. Central production or control can assist a gaming establishment or other entity in maintaining appropriate records, controlling gaming, reducing and preventing cheating or electronic or other errors, reducing or eliminating win-loss volatility and the like.

In another embodiment, one or more of the gaming devices are in communication with a central server or controller for monitoring purposes only. That is, each individual gaming device randomly generates the game outcomes to be provided to the player and the central server or controller monitors the activities and events occurring on the plurality of gaming devices. In one embodiment, the gaming network includes a real-time or on-line accounting and gaming information system operably coupled to the central server or controller. The accounting and gaming information system of this embodiment includes a player database for storing player profiles, a player tracking module for tracking players and a credit system for providing automated casino transactions.

A plurality of the gaming devices are capable of being connected together through a data network. In one embodiment, the data network is a local area network (LAN), in which one or more of the gaming devices are substantially proximate to each other and an on-site central server or controller as in, for example, a gaming establishment or a portion of a gaming establishment. In another embodiment, the data network is a wide area network (WAN) in which one or more of the gaming devices are in communication with at least one off-site central server or controller. In this embodiment, the plurality of gaming devices may be located in a different part of the gaming establishment or within a different gaming establishment than the off-site central server or controller. Thus, the WAN may include an off-site central server or controller and an off-site gaming device located within gaming establishments in the same geographic area, such as a city or state. The WAN gaming system may be substantially identical to the LAN gaming system described above, although the number of gaming devices in each system may vary relative to each other.

In another embodiment, the data network is a global computer network, such as the Internet, or an intranet network, and the gaming system may be considered an online system, a mobile system, or the like. In this embodiment, the operation of the gaming device can be viewed at the gaming device with at least one web browser, or application, such that access to the data network is feasible. In this embodiment, operation of the gaming device and accumulation of credits may be accomplished with a connection to the central server or controller through a conventional phone or other data transmission line, digital signal line (DSL), T-1 line, coaxial cable, fiber optic cable, or other suitable connection. In this embodiment, players may access a game page from any location where a network connection and computer, or other gaming device 10, are available. For example, either of the gaming devices of FIGS. 1C and 1D are suitable for accessing such a data network.

The expansion in the number of computers and number and speed of internet connections in recent years increases opportunities for players to play from an ever-increasing number of remote sites. It should be appreciated that enhanced bandwidth of digital wireless communications may render such technology suitable for some or all communications according to some embodiments of the present invention, particularly if such communications are encrypted. Higher data transmission speeds may be useful for enhancing the sophistication and response of the display and interaction with the player.

In another embodiment, a plurality of gaming devices at one or more gaming sites may be networked to a central server in a progressive configuration, wherein a portion of each wager to initiate a base or primary game may be allocated to bonus or secondary event awards. In one embodiment, a host site computer is coupled to a plurality of the central servers at a variety of mutually remote gaming sites for providing a multi-site linked progressive automated gaming system. In one embodiment, a host site computer may serve gaming devices distributed throughout a number of properties at different geographical locations including, for example, different locations within a city or different cities within a state.

In one embodiment, the host site computer is maintained for the overall operation and control of the system. In this embodiment, a host site computer oversees the entire progressive gaming system and is the master for computing all progressive jackpots. All participating gaming sites report to, and receive information from, the host site computer. Each central server computer is responsible for all data communication between the gaming device hardware and software and the host site computer.

In some embodiments, the data network may be integrated into an existing network platform, for example, a social networking site. For example, in one embodiment, the data network may comprise an application within a social networking site, e.g., Facebook, whereby players may access the data network via a connection to the social networking site. Such an integrated arrangement may be advantageous for applications of embodiments of the present invention that seek to have near immediate access to a significant potential customer base.

In further embodiments, the data network may be accessed via a downloadable application to a mobile device, such as a smartphone, a tablet, a mobile computer, or the like. As in known in the mobile device industry, such a downloadable application may be stored at a remote server, and upon request, a player may utilize a mobile device to download such downloadable application to be stored locally on the mobile device. Such downloadable application may access the data network through the mobile device's network connection, and provide the player a convenient means through which to access the data network. In alternative embodiments, the downloadable application may not require a network connection on a regular basis, and a game may be accessible locally on the mobile device. However, in such embodiments, some of the benefits of networked game play, such as competitions, updates, etc., may not be available until the mobile device reconnects to the data network.

Figure 3:
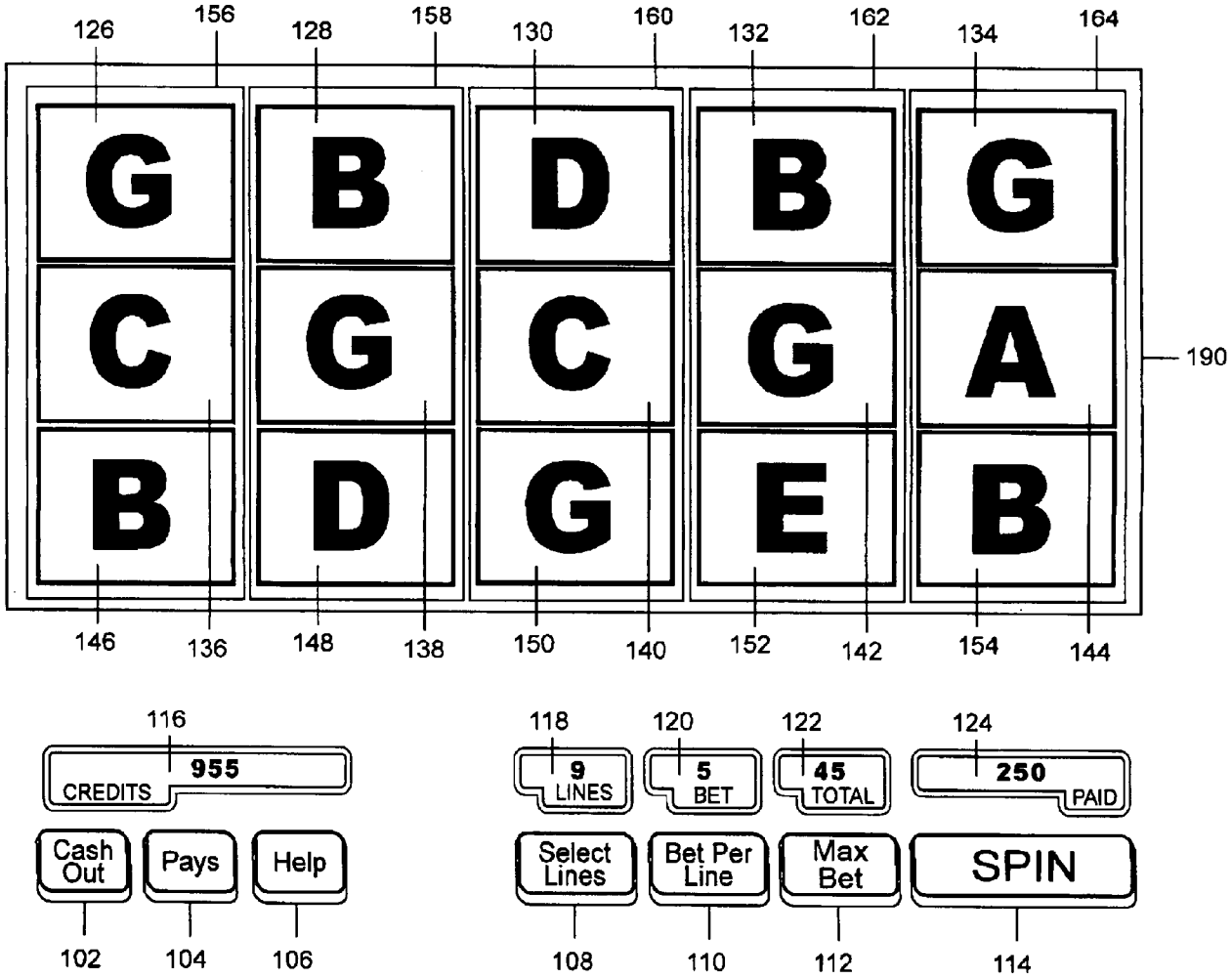
FIG. 3 shows a game screen with a winning symbol combination in the symbol matrix during the initial opportunity to form winning symbol combinations in accordance with one embodiment of the present invention.

Referring now to FIGS. 3-9, embodiments of the present invention comprise winning symbol combinations formed during the initial and subsequent opportunities to form winning symbol combinations, as generally shown in symbol matrix 190. In FIG. 3, a winning G-G-G-G-G symbol combination at 126, 138, 150, 142, 134 forms on a payline in the symbol matrix 190 and generates a 250 credit award according to a predetermined pay schedule (not shown) as shown on the Paid meter at 124. Subsequently, in FIG. 4, the G symbols comprising the winning G-G-G-G-G combination at 126, 138, 150, 142, 134 are removed from the symbol matrix 190. In many embodiments, all of the symbols in the winning symbol combination are removed at the same time.

Figure 5:
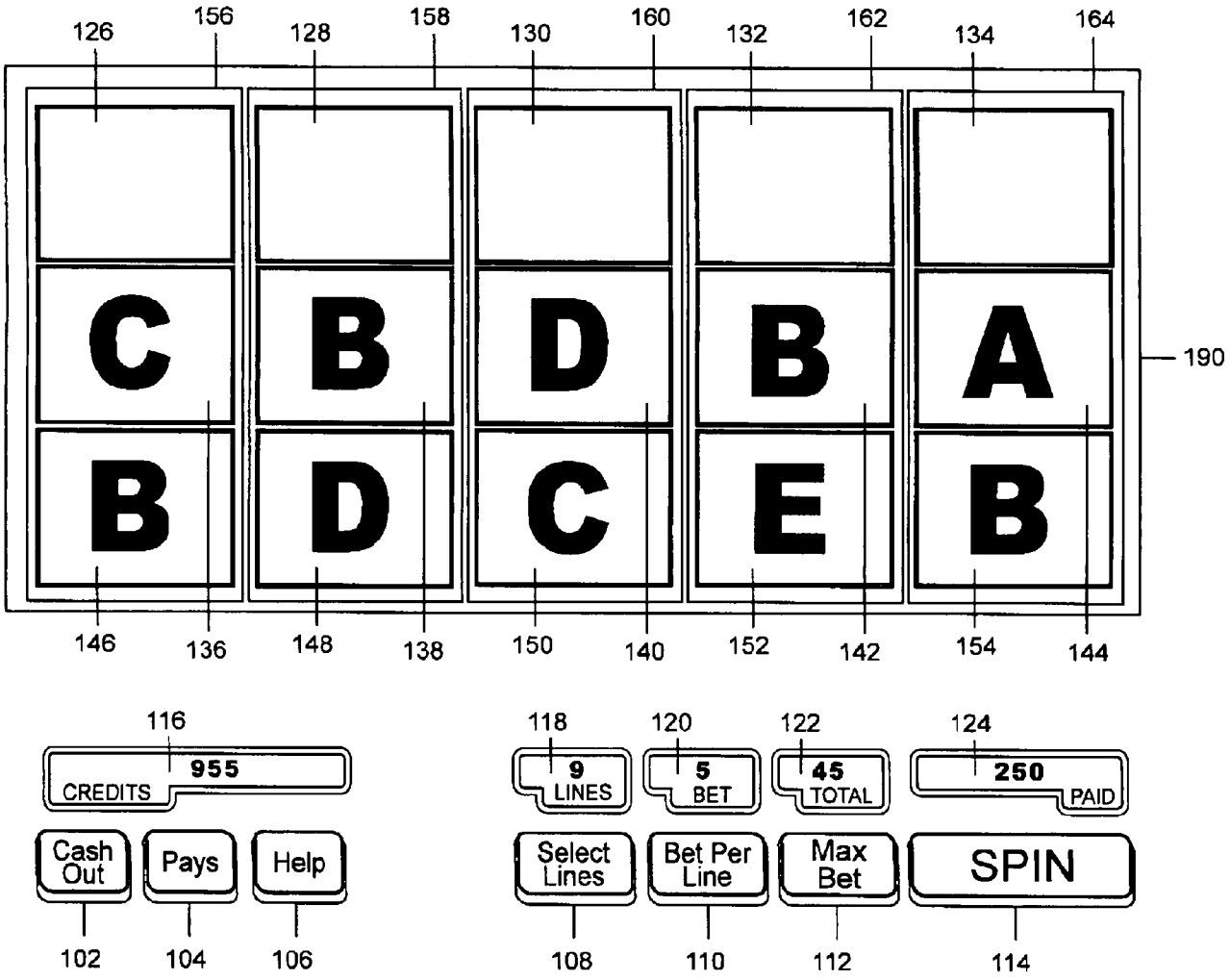
FIG. 5 shows a game screen with the remaining symbols re-adjusted within the symbol matrix to fill-in any vertical gaps between symbols in accordance with one embodiment of the present invention.

Moving to FIG. 5, the symbols in the columns readjust to eliminate the gaps by dropping to the lowest available position in each respective column. All of the symbols readjust in the symbol matrix 190 at the same time, as follows: in the second column 158 from the left of the symbol matrix 190, the B symbol in the top symbol position 128 drops into the middle symbol position 138; in the third column 160 from the left of the symbol matrix 190, the D and C symbols in the top and middle symbol positions 130, 140 drop into the middle and bottom symbol positions 140, 150; and in the fourth column 162 from the left of the symbol matrix 190, the B symbol in the top symbol position 132 drops into the middle position 142.

Figure 6:
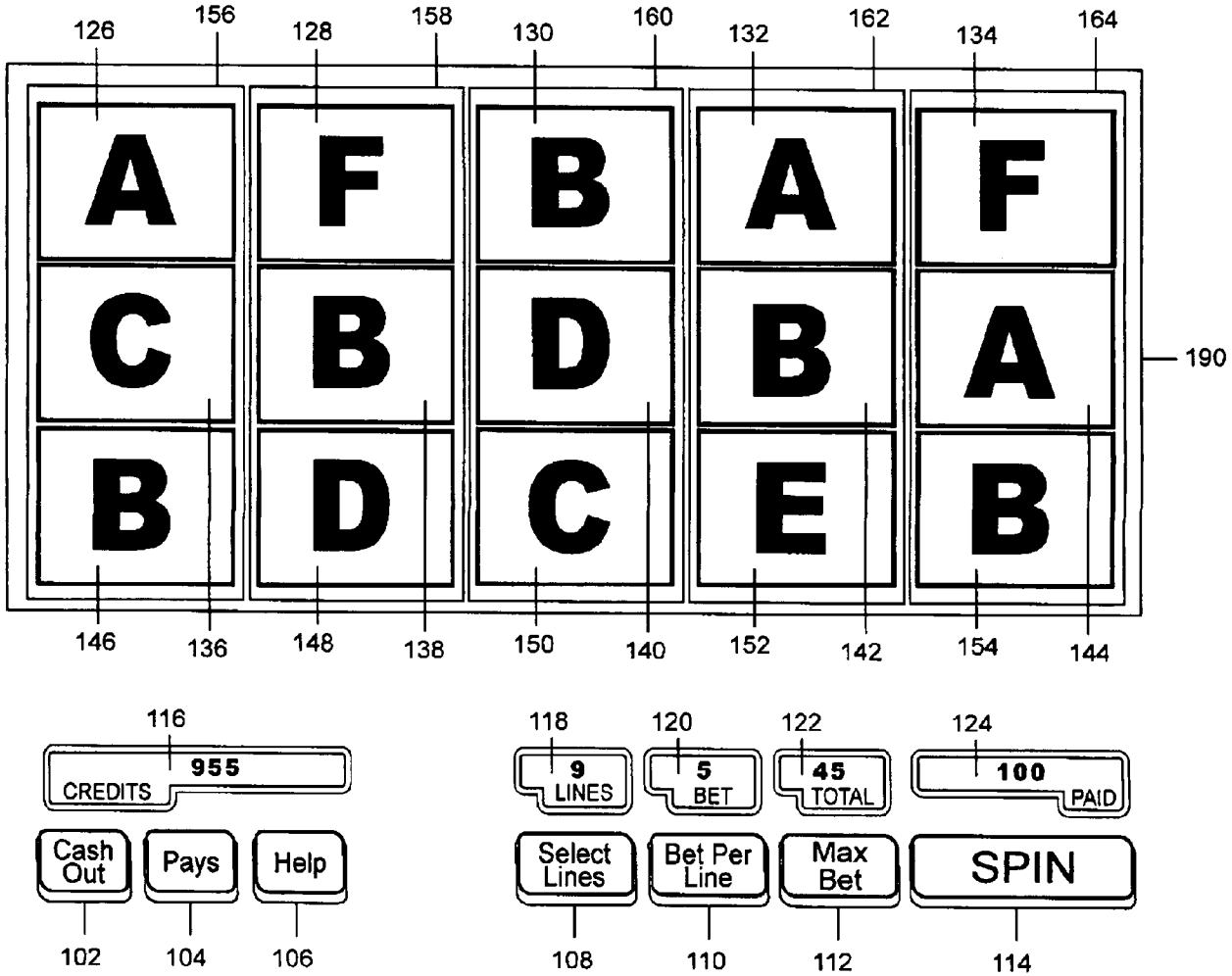
FIG. 6 shows a game screen with replacement symbols appearing in all vacant symbol positions of the symbol matrix to provide a second opportunity to form winning symbol combinations in accordance with one embodiment of the present invention.

In FIG. 6, replacement symbols appear in each vacant symbol position of the respective columns. Generally, each of the replacement symbols appear in the symbol matrix 190 at the same time, with each symbol selected from the reel strip associated with that symbol position, as follows: iIn the first column 156 from the left of the symbol matrix 190, an A symbol appears in the top symbol position 126; in the second column 158 from the left of the symbol matrix 190, an F symbol appears in the top symbol position 128; in the third column 160 from the left of the symbol matrix 190, a B symbol appears in the top symbol position 130; in the fourth column 162 from the left of the symbol matrix 190, an A symbol appears in the top symbol position 132; and in the fifth column 164 from the left of the symbol matrix 190, an F symbol appears in the top symbol position 134.

Figure 4:
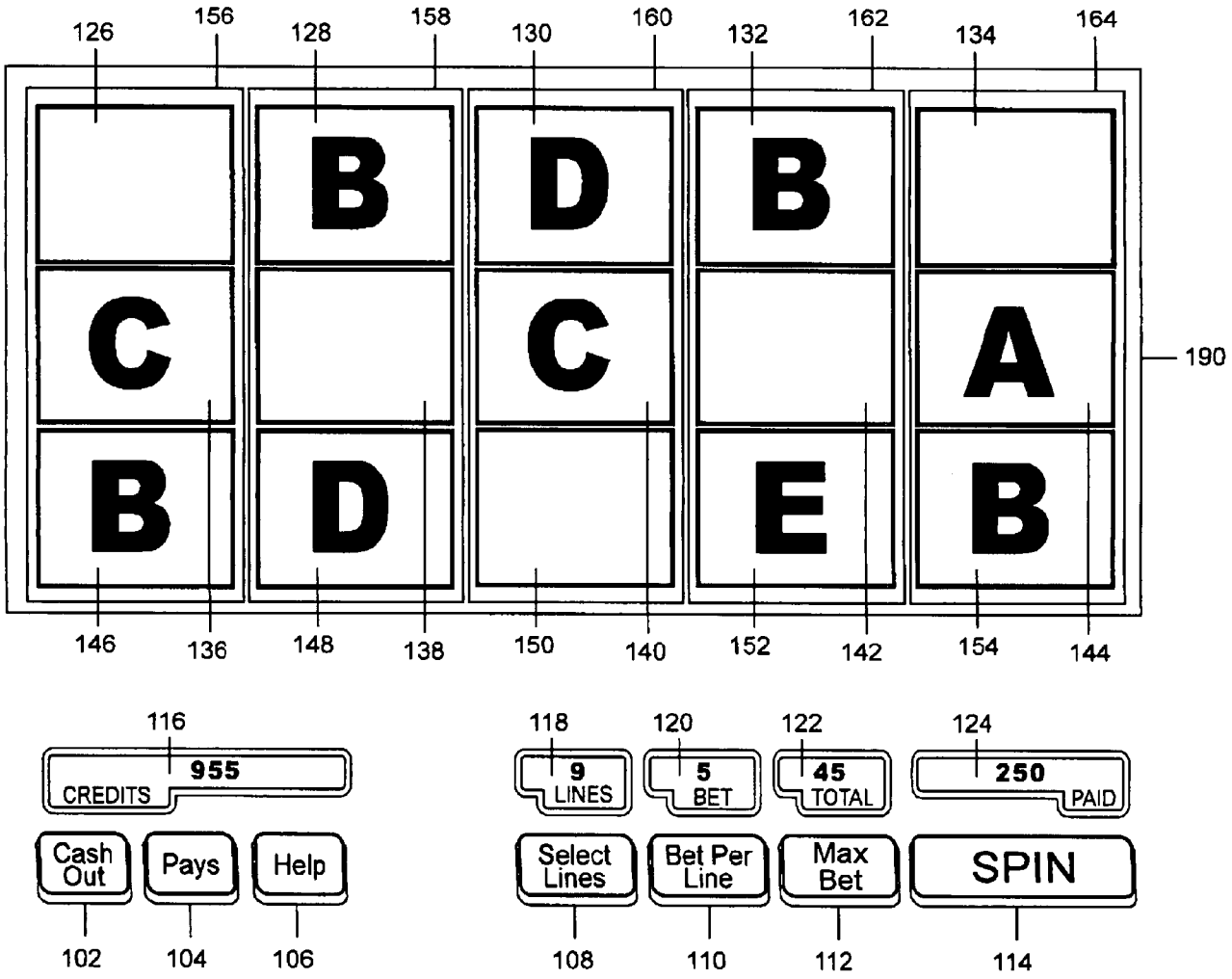
FIG. 4 shows a game screen with all symbols comprising the winning symbol combinations removed from the symbol matrix in accordance with one embodiment of the present invention.

The replacement symbols provide an additional opportunity to form a winning symbol opportunity. For example, FIG. 4 shows the replacement symbols forming a winning B-B-B-B-B combination at 146, 138, 130, 142, 154, and generating a 100 credit award according to a predetermined pay schedule (not shown), bringing the total award to 350, as shown on the Paid meter at 124.

Figure 7:
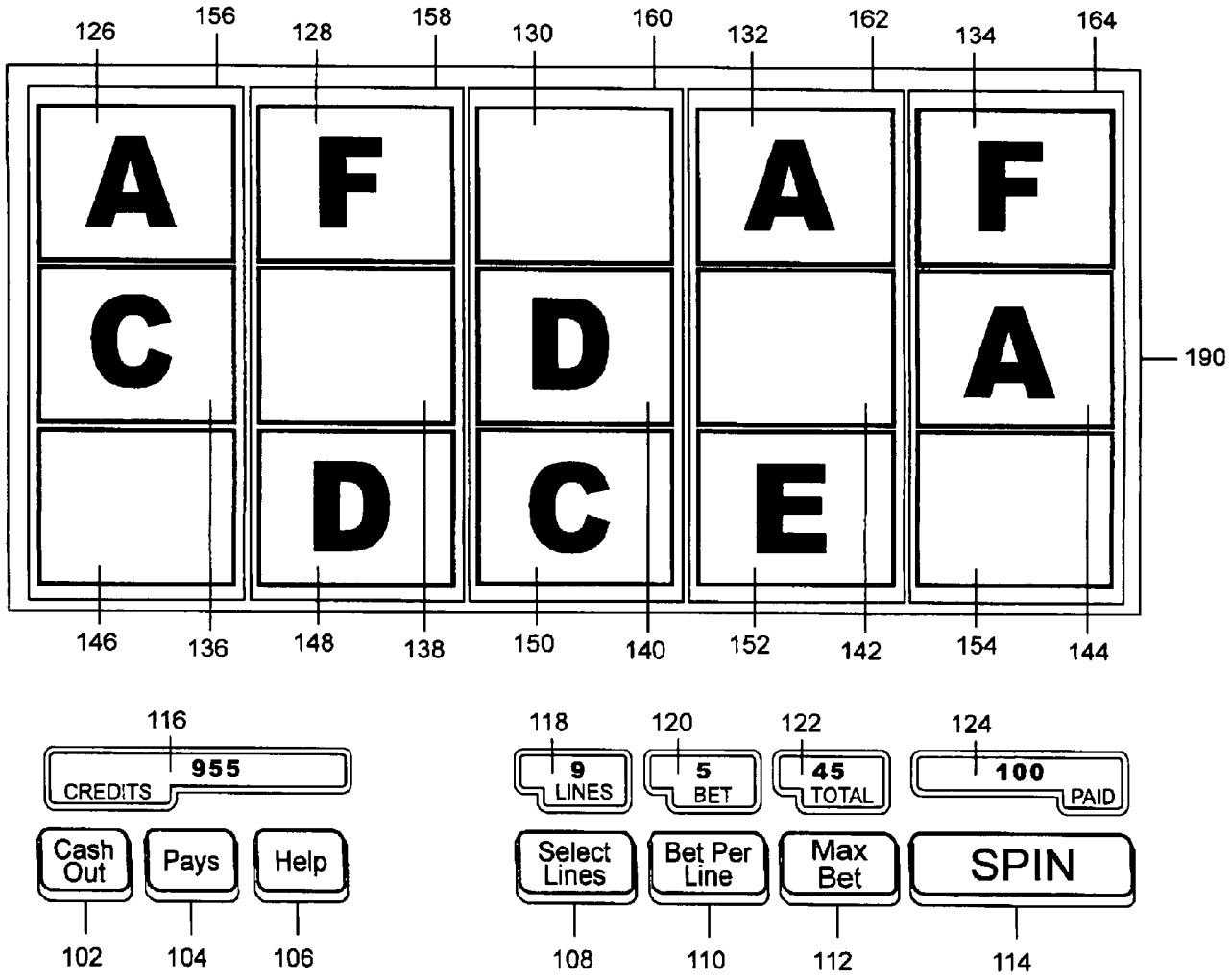
FIG. 7 shows a game screen with all symbols comprising the winning symbol combinations removed from the symbol matrix in accordance with one embodiment of the present invention.
Figure 8:
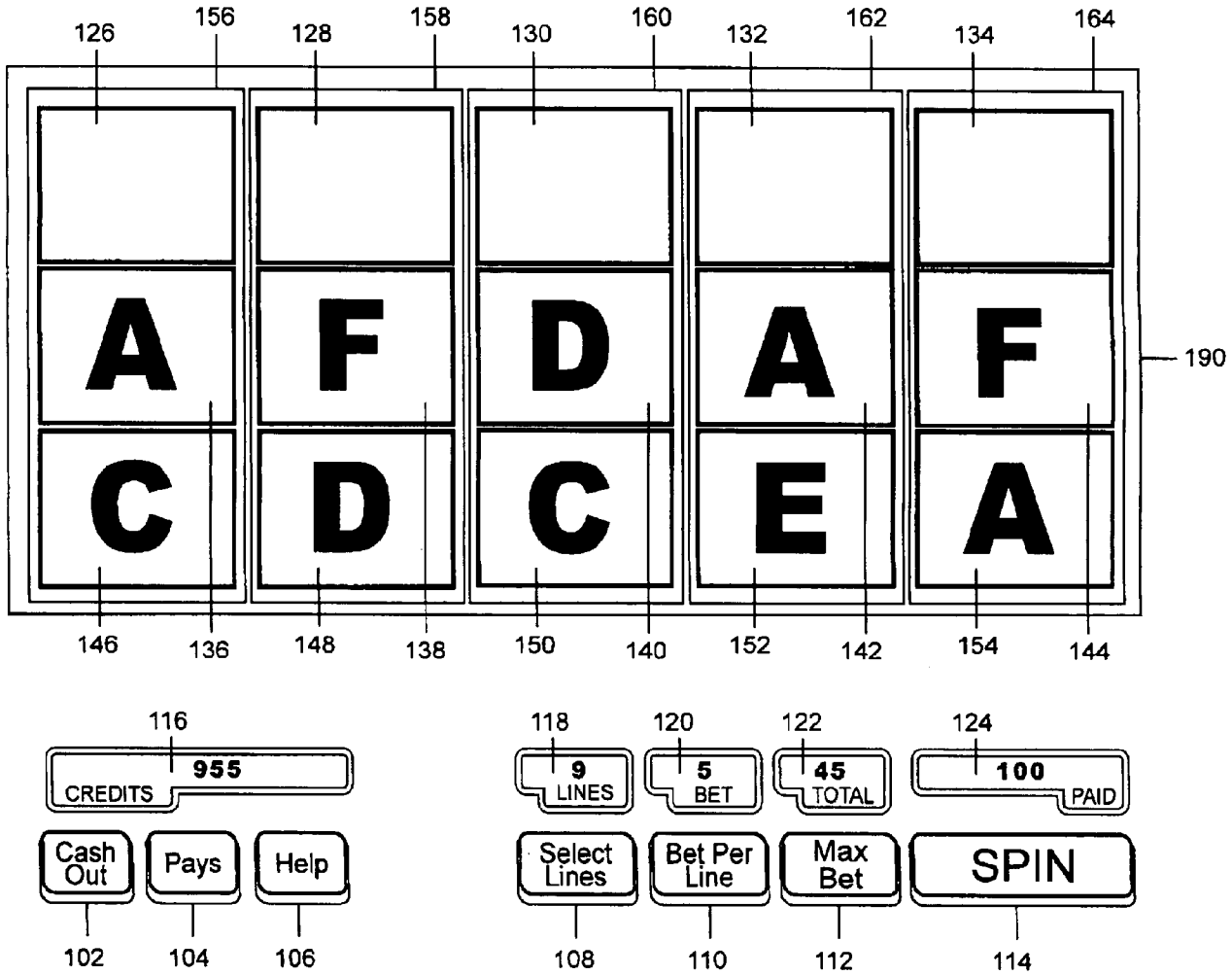
FIG. 8 shows a game screen with the remaining symbols re-adjusted within the symbol matrix to fill-in any vertical gaps between symbols in accordance with one embodiment of the present invention.

In FIG. 7, the B symbols comprising the winning B-B-B-B-B combination at 146, 138, 130, 142, 154 are removed from the symbol matrix 190, similar to the steps performed above. Similarly, in FIG. 8, the symbols in the columns readjust to eliminate the gaps by dropping to the lowest available position in each respective column. All of the symbols readjust in the symbol matrix 190 at the same time, as follows: in the first column 156 from the left of the symbol matrix 190, the A and C symbols in the top and middle symbol positions 126, 136 drop into the middle and bottom symbol positions 136, 146; in the second column 158 from the left of the symbol matrix 190, the F symbol in the top symbol position 128 drops into the middle symbol position 138; in the fourth column 162 from the left of the symbol matrix 190, the A symbol in the top symbol position 132 drops into the middle position 142; and in the fifth column 164 from the left of the symbol matrix 190, the F and A symbols in the top and middle symbol positions 134, 144 drop into the middle and bottom symbol positions 144, 154.

Figure 9:
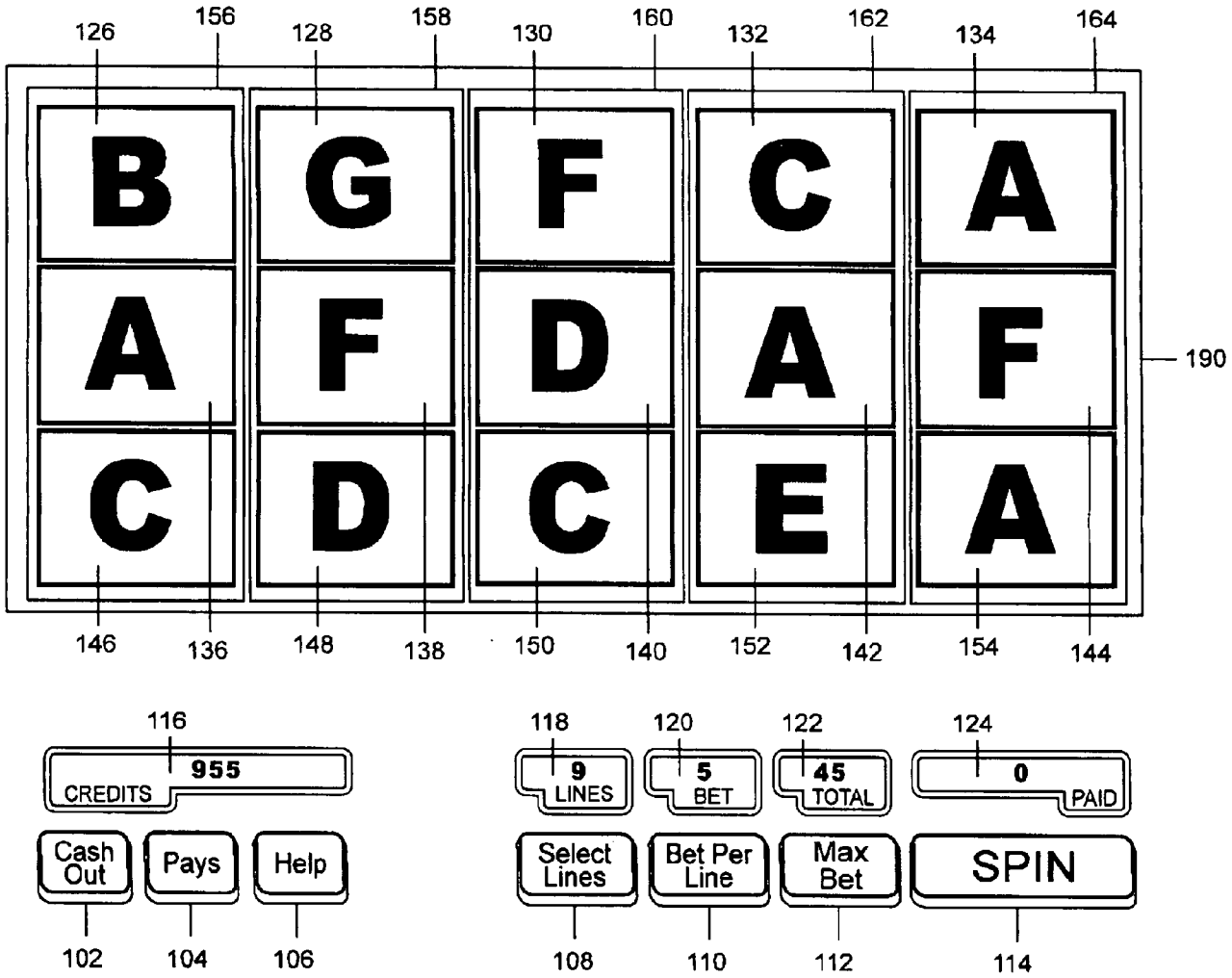
FIG. 9 shows a game screen with replacement symbols appearing in all vacant symbol positions of the symbol matrix to provide a third opportunity to form winning symbol combinations in accordance with one embodiment of the present invention.

In FIG. 9, additional replacement symbols appear in each vacant symbol position of the respective columns. Generally, all of the replacement symbols appear in the symbol matrix 190 at the same time, with each symbol selected from the reel strip associated with that symbol position, as follows: in the first column 156 from the left of the symbol matrix 190, an B symbol appears in the top symbol position 126; in the second column 158 from the left of the symbol matrix 190, an G symbol appears in the top symbol position 128; In the third column 160 from the left of the symbol matrix 190, a F symbol appears in the top symbol position 130; in the fourth column 162 from the left of the symbol matrix 190, an C symbol appears in the top symbol position 132; and in the fifth column 164 from the left of the symbol matrix 190, an A symbol appears in the top symbol position 134.

The replacement symbols provide another opportunity to form a winning symbol opportunity. FIG. 9, however, shows the replacement symbols do not form any additional winning symbol combinations, the 350 credits awarded during the game issue to the player, and the game ends until the player elects to bet again.

At the conclusion of each game, all credits awarded are added to the player's balance of credits. As long as the player has credits on the Credit meter 116, the player may continue to play the game or the player may also collect the balance of credits by pressing the Cash Out button 102. In addition, the player may press the Help button 106 to view the rules of the game.

A variety of additional alternative embodiments of such type of system are disclosed by commonly owned U.S. Pat. No. 7,887,407, the disclosure of which is incorporated by reference herein in its entirety. In addition, certain features of U.S. Pat. Nos. 6,910,962 and 7,357,713 are related to features of embodiments of the present invention, and the disclosures of such references are hereby incorporated by reference herein in their respective entireties.

In addition to the features above, embodiments of the present invention include a variety of methods of extending play by receiving additional spins from the same initial wager. In an exemplary extended play embodiment, a plurality of sets of reel strips (i.e., the mathematical set(s) used to determine which symbols are placed into symbol positions during game play), for example, ReelSet1, ReelSet2, etc. are provided. After an initial wager is made, an initial spin uses ReelSet1. After the reels are spun, a play matrix is populated with symbols, and awards are made for winning symbol combinations, as described hereinabove.

In one embodiment, if there is a presence of a designated "activator" symbol in the matrix (i.e., a predetermined symbol whose mere presence in any specific reel, payline, symbol position of the like, may cause such symbol to be an "activator" as used herein), each symbol in the matrix may "flip," revealing a new symbol in its place. In some embodiments, those new symbols are provided by ReelSet2, using the same set of randomly selected reel stops used for ReelSet1. For example, if the initial game randomly chose reel stops 18, 19 and 20 for a particular reel in the game, upon positioning of an activator, such symbols may be replaced with the symbols corresponding to reel stops 18, 19 and 20 on ReelSet2. New win evaluations are made and this process continued (using ReelSet3, ReelSet4, and so on) until the designated activator symbol is not present in the play matrix.

In an alternate embodiment, different stops are randomly generated each time the activator symbol is present. In yet another embodiment, certain predetermined symbols (such as wild symbols or bonus symbols) "lock" in place, and may not be "flipped" or replaced with new symbols each time the activator is present.

In another extended play embodiment, certain winning combinations are associated with a number of free spins. For example, in one embodiment, five symbols (e.g., cherries) on an active pay line may award three extra spins. In such an embodiment, a meter on the display indicates the number of earned spins remaining. In such embodiments, the winning symbol combination is usually devoid of any "bonus" symbols, such that the award granted for an ordinary winning combination may include with it both an award of credits and additional spin(s) or play(s) on the game device.

In another extended play embodiment, certain designated symbols have the effect of causing symbols to be deleted from the play matrix. Generally, such deletion occurs in a predetermined pattern relative to the position occupied by the special symbol, and replaced by new symbols. The replacement occurs after a win evaluation, and this process continues until no special symbols are present in the play matrix.

It should be emphasized that the above-described embodiments of the present invention are merely possible examples of implementations, merely set forth for a clear understanding of the principles of the invention. Many variations and modifications may be made to the above-described embodiment(s) of the invention without departing substantially from the spirit and principles of the invention. For example, an element disclosed by one embodiment of the present invention may be included in any other disclosed embodiment, where suitable. All such modifications and variations are intended to be included herein within the scope of this disclosure and the present invention.

What is claimed is:

1. A game device comprising:

a first set of reels and a second set of reels, each set of reels including a plurality of reels, each of the reels including a plurality of symbol positions;

a plurality of symbols, at least one of the plurality of symbols located in each of the positions in the first set of reels and at least one of the plurality of symbols located in each of the positions in the second set of reels;

an activator symbol located at one of the plurality of symbol positions on the first set of reels;

a replacement symbol position in the first set of reels and a corresponding replacement symbol position in the second set of reels;

at least one processor for accessing a plurality of instructions which, when executed by the one processor, cause the at least one processor to operate with an at least one display device and an at least one input device to:

accept a wager entered through the input device;

determine a reel stop for each of the reels in the first set of reels;

display a portion of the first set of reels on the display device according to the reel stops;

determine if the activator symbol is displayed on the display device, and if so, replace the symbol in the replacement symbol position in the first set of reels with the symbol in the second set of reels in the corresponding replacement symbol position;

display a game outcome on the display device; and determine whether to issue an award based on the game outcome.

2. The game device of claim 1, wherein the game device further comprises:

a third set of reels comprising a plurality of reels, each reel comprising a plurality of symbol positions;

a plurality of symbols, at least one of the plurality of symbols located in each of the positions in the third set of reels; and a second replacement symbol position in the first set of reels and a corresponding replacement symbol position in the third set of reels, wherein the symbol in the third set of reels in the corresponding replacement symbol position replaces the symbol in the first set of reels in the replacement symbol position.

3. The game device of claim 1, wherein a set of predetermined symbols in the first set of reels are not replaced by symbols from the second set of reels.

4. The game device of claim 3, wherein the set of predetermined symbols comprise a wild symbol and a bonus symbol.

5. The gaming device of claim 1, further comprising a payline associated with the reels.

6. The gaming device of claim 5, wherein there is a winning symbol combinations on the payline.

7. The gaming device of claim 1, wherein the symbols include at least one bonus symbol.

8. The gaming device of claim 7, further comprising at least one bonus award provided to the player when a winning symbol combination including the bonus symbol occurs on the reels.

9. The gaming device of claim 1, wherein the gaming device is one of a slot machine, a mobile device, or a personal computer.

10. The gaming device of claim 1, wherein the gaming device is one of a slot machine, a mobile device, or a personal computer.

11. A method for operating a game device comprising:

providing a game device comprising:

a first set of reels and a second set of reels, each set of reels comprising a plurality of reels, each of the reels including a plurality of symbol positions;

an activator symbol located at one of the plurality of symbol positions on the first set of reels;

a processor for accessing a plurality of instructions which, when executed by the one processor, cause the at least one processor to operate with an at least one display device and an at least one input device to provide a game comprising:

accepting a wager through the input device;

populating a plurality of symbols, at least one of the plurality of symbols located in each position in each of the sets of reels;

determining a reel stop for each of the reels in the first set of reels;

displaying a portion of the first set of reels on the display device according to the reels stops;

issuing an award if a winning symbol combination of a plurality of symbols is displayed; and determining if the activator symbol is displayed on the display device, and if so, replace a symbol in a replacement symbol position in the first set of reels with a symbol in a corresponding replacement symbol position in the second set of reels.

12. The method of claim 11, wherein the winning symbol combination is devoid of any bonus symbols.

13. The method of claim 11, further comprising a payline associated with the reels.

14. The method of claim 13, wherein the symbol positions associated with a winning symbol combinations are on the payline.

15. The method of claim 11, wherein the gaming device is one of a slot machine, a mobile device, or a personal computer.

16. A game device comprising:

a first set of reels and a second set of reels, each set of reels including a plurality of reels, each of the reels including a plurality of symbol positions;

a plurality of symbols, at least one of the plurality of symbols located in each of the positions in the first set of reels and at least one of the plurality of symbols located in each of the positions in the second set of reels;

at activator symbol located at one of the plurality of symbol positions on the first set of reels;

a processor for accessing a plurality of instructions which, when executed by the one processor, cause the at least one processor to operate with an at least one display device and an at least one input device to:

provide a game comprising:

a wager accepted through the input device and relayed to the at least one processor;

a reel stop for each of the reels in the first set of reels;

a display of a portion of the first set of the reels on the display device according to the reel stops;

a determination if the activator symbol is displayed on the display device, and if so, a second plurality of symbols to replace a subset of a first plurality of symbols, located in the first set of reels, the second plurality of symbols selected from the second reel set and wherein the first plurality of symbols and the second plurality of symbols have corresponding symbol positions; and at least one predetermined winning symbol combination of a plurality of winning symbol combinations, wherein the predetermined winning symbol combination is associated with an award.

17. The game device of claim 16, wherein the subset of the first plurality of symbols being replaced is dependent upon the activator symbol.

18. The game device of claim 17, wherein the activator symbol is associated with a predetermined replacement pattern relative to its position within the plurality of symbol positions.

19. The gaming device of claim 16, wherein the symbol positions associated with a winning symbol combinations are on a payline within the reels.

* * * * *